US005329659A

United States Patent [19]

Reinert, Sr.

[11] Patent Number: 5,329,659

[45] Date of Patent: Jul. 19, 1994

[54] LAUNDERING FACILITY AND METHOD

[76] Inventor: Gary L. Reinert, Sr., 4319 Middle Rd., Allison Park, Pa. 15101

[21] Appl. No.: 58,244

[22] Filed: May 10, 1993

[51] Int. Cl.[5] ..... D06F 35/00

[52] U.S. Cl. ..... 8/158; 55/385.2; 68/3 R; 68/208; 68/210; 210/806; 210/96.1; 210/104; 210/143; 210/257.1; 210/314; 454/238

[58] Field of Search ..... 68/210, 3 R, 208; 8/158, 159; 454/238, 239, 253; 55/385.2; 210/806, 96.1, 104, 143, 257.1, 314, 340

[56] References Cited

U.S. PATENT DOCUMENTS

| | | | |
|---|---|---|---|
| 1,967,940 | 7/1934 | Johnson | 68/3 R X |
| 3,611,906 | 10/1971 | Lorenz | 454/238 |
| 4,441,340 | 4/1984 | Kaplan | 68/208 X |
| 4,820,319 | 4/1989 | Griffis | 55/385.2 X |
| 5,003,794 | 4/1991 | Griffis | 68/210 X |
| 5,004,483 | 4/1991 | Eller et al. | 55/385.2 X |
| 5,064,457 | 11/1991 | Weber | 55/385.2 |
| 5,099,751 | 3/1992 | Newman et al. | 454/239 X |
| 5,246,590 | 9/1993 | Dobrez et al. | 210/96.1 X |

FOREIGN PATENT DOCUMENTS

| | | | |
|---|---|---|---|
| 38541 | 3/1984 | Japan | 454/238 |

*Primary Examiner*—Philip R. Coe
*Attorney, Agent, or Firm*—Douglas G. Glantz

[57] ABSTRACT

This invention consists of a method and means for laundering clothing contaminated with asbestos fibers and/or with lead, herein called the contaminants. The method and means employed by this invention decontaminates the clothing in an environmentally contained, controlled and safe facility. The facility and the method described in association therewith permits contaminated clothing to be brought into the containment area, laundered and dried within the same contained, environmentally controlled, safe area. Clean clothing is then removed for further sorting, repairs, folding, counting and storing operations in another separated room of the facility. The facility and the method described in association therewith protect the health of the laundry operator and prevent the contaminants from being released into the atmosphere by the process itself. It also prevents contaminants from being carried from the interior of the facility by the person conducting the laundry operation. The method and means also prevent the release of the contaminants into the atmosphere at the time the contaminated clothing is delivered to the facility. The method and means also prevent the release of the contaminants by the laundered clothing themselves after they have been laundered. This is assured by the methods and means utilized to prevent recontaminating the clothing after it has been laundered. The method and means ensure the filtering of the laundry waste water to a level that is safe for its disposal through the sewer.

20 Claims, 2 Drawing Sheets

LAUNDERING FACILITY AND METHOD

BACKGROUND OF THE INVENTION

This invention relates to a method and means for laundering clothing contaminated with asbestos fibers and/or with lead, which decontaminates them, in an environmentally contained, controlled and safe facility.

The contamination of our living environment with asbestos and/or lead, is a serious but well known problem. The abatement, for instance, of the asbestos and lead from buildings of all types is a major undertaking costing billions of dollars every year.

During the asbestos and lead abatement process workers are required to wear protective clothing in addition to respirators equipped with HEPA (High Efficiency Particulate Absolute) Filter cartridges. This protective clothing has to be disposed of as contaminated material, additionally aggravating another serious problem, which is the creation of large quantities of contaminated solid waste which in turn increases the already heavy burden imposed on landfills nationwide in addition to the cost of replacing the contaminated clothing, which is very high indeed.

Recycling has become a very serious obligation of every American and it is becoming law in many instances. Recycling by laundering the clothing used in the asbestos and lead abatement projects could become a major contribution to the reduction of the solid waste problem, provided:

a. Safety procedures and means are included in the laundering process in order to protect the operator's health and to protect the surrounding atmosphere from contamination.

b. Methods and means are in place to prevent the clothing from getting re-contaminated within the work area of the laundry facility, after they have been laundered and before they leave the laundry facility.

c. Any quantity of the contaminants found on the laundered suits, after they exit the laundry facility, is insignificant or at most the maximum allowed by regulations.

d. No waste water will be disposed through the sewer system that is not in compliance with EPA regulations for maximum allowable content for the above mentioned contaminants.

It is therefore a principal object of the invention to provide a method and means for laundering asbestos and/or lead contaminated clothing which decontaminate them and which include safety procedures, controls and regular testings, as intrinsical parts of the decontamination process, implicating both, the protection of the laundry operator's health and the protection of the surrounding atmosphere from being contaminated with the listed contaminants from the laundry process.

A further object of the invention is to provide a method and means for laundering asbestos and/or lead contaminated clothing which decontaminate them and which include means combining microprocessor controlled washer technology with a Containment Area controlled environment, engineered with state of the art technology. The invention also provides methods and means for the constant differential pressure monitoring and recording, methods and means for constant air monitoring and testing by independent laboratory of both the Containment Area as a whole as well as the Operator's Breathing Area in particular. It also provides methods and means for testing the clothing, at regular intervals, by an independent laboratory for contaminant content, prior to and after laundering, all of which assures the laundered clothing does not get re-contaminated within the laundry facility.

A further object of the invention is to provide a method and means for said laundry facility not to require a wall between its washer and dryer areas because of its washer equipment technology and because of its environmental control engineering, which directs the air flow in a manner that does not allow contaminated air to flow towards the dryer as proven by its monitoring and testing methods and means which becomes obvious to those trained in the art, in the description of the drawings and in the preferred embodiment.

A further object of the invention is to provide an improved method and means for laundering asbestos and/or lead contaminated clothing to decontaminate them. The method and means provide clean, decontaminated clothing, that can be safely worn. Said clothing leaves the laundry facility with an insignificant amount of the listed contaminants on it, if any, or at the most within the maximum allowed by regulation.

A further object of the invention is to provide an improved method and means for laundering asbestos and/or lead contaminated clothing with the purpose of decontaminating them including means for filtering the contaminated waste water down to a content/liter that is acceptable by EPA regulations for its disposal through the sewer system, further including means for reducing the contact between the hot, contaminated waste water and the Containment Area ambient air to an insignificant level.

BRIEF DESCRIPTION OF THE DRAWINGS

FIG. 1 also shows the clean air in-flow and its direction, indicated by arrows, up and towards the HEPA Air Filtration Machines. Also shown is the clean clothing, folding, repairing, counting, storage and office areas.

SUMMARY OF THE INVENTION

An improved method and means for laundering clothing contaminated with asbestos fibers and/or lead residues, which decontaminate them, is described, wherein an environmentally controlled enclosure is created to define a washer/dryer/filtering area without the need for dividing walls between them. Vented rooms are provided to permit the operator to enter the washer/dryer/filtering area to perform the washing and drying procedures in such a manner so as to prevent the escape of contaminants from the enclosure and to the atmosphere and to ensure (in conjunction with the negative air engineering, the washer results repeatability, the method of handling the contaminated clothing before washing it, the monitoring and testing procedures and others explained hereinafter) that the washed clothes will not be contaminated during the drying procedures. At the same time it is also assured the operator's safety and that any of the above mentioned contaminants on the clothes, if any after laundering, will be at the most within the allowable safe level.

Means are also provided for the filtering and safe disposal of the contaminated wash water. A large clean room area is provided, separated from the washer/dryer/filtering area by walls and communicating with said area through the above mentioned vented rooms, this large clean room area is used for the purpose of sorting, repairing, folding and storing of the laundered clothing.

DESCRIPTION OF THE PREFERRED EMBODIMENT

Figure 1:
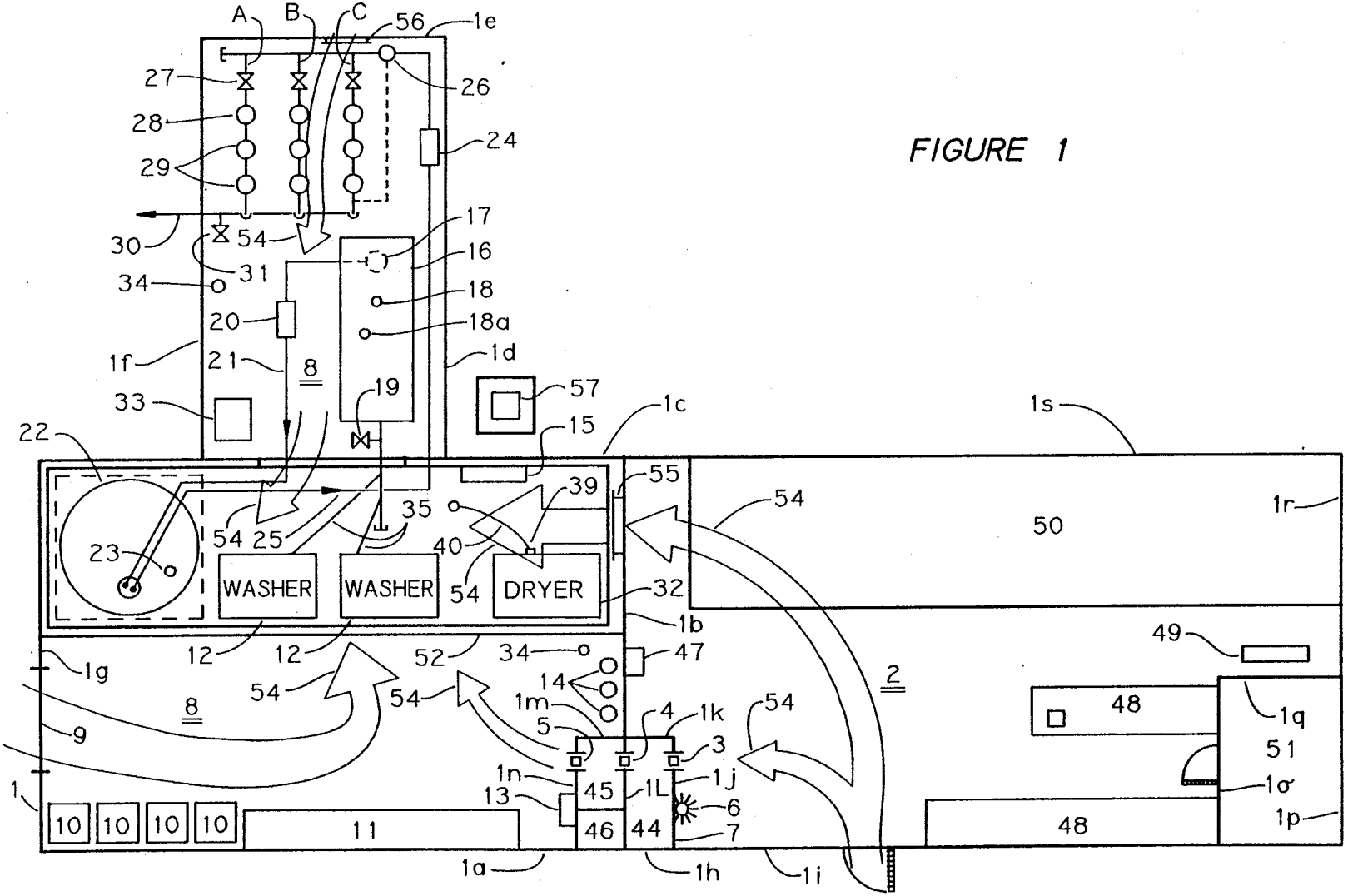
FIG. 1 is a schematic of the floor plan of the overall facility, subject of this invention, which shows: the washers, the dryer, the filtration system, the settling tank, the holding tank, filter banks, pumps, pressure gauges, sensors, controls and piping.

Referring to FIG. 1, the numeral 8 designates the overall containment area and waste water filtration area and the numeral 2 designates the overall clean clothes, sorting, repairing, folding, storage and office area.

The Containment and Filtration Areas 8 include Outer Walls 1, 1*a*, 1*h*, 1*j*, 1*k*, 1*b*, 1*c*, 1*d*, 1*e*, 1*f*, 1*g*, and Overhead Door 9.

Area 8 includes Clean Room/Airlock 44, defined by Walls 1*h*, 1*j*, 1*k* and 1*l* and Shower Room 45, 46 defined by Walls 1*a*, 1*l*, 1*m* and 1*n*. Vented Solid Doors 3, 4 and 5 are provided in Walls 1*j*, 1*l* and 1*n*. Vents on Doors 3, 4 and 5 are positioned so that air, drawn in by Air Filtration HEPA (High Efficiency Particulate Absolute) Machines 36, may pass from the outside, through Clean Clothing Area 2, through Vent 55 and through Vents 3, 4 and 5 into the Clean Room/Airlock 44, the Shower Room 45, 46 and into the Laundering Area, as indicated by arrows 54. Clean, outside air is also drawn in through Vent 56 on Wall 1*e*. All vents are designed so as to prevent air from moving from the Shower Room 45, 46, through Clean Room/Airlock 44 and into the Clean Clothing Area 2. They have a flap over them on the negative pressure side. Arrows 54 indicate the direction of the flow of clean air into the containment, through the several self-closing flapped vents, throughout the Containment Area.

FIG. 1—Microprocessor controlled, programmable Washing Machines 12 are provided in Area 8 and they have Drain Lines 35 extending therefrom to Holding Tank 16. Sampling Outlet 19 is provided for testing the prefiltering waste water contamination level.

Electrical Control Panel 13 with indicators and alarms, controls all the electrical functions within the Containment Area, by means of microprocessor based programmable controller; manual override is available to the operator at all times, who can manually control the process in case of any malfunction.

Holding Tank 16 has an automatic Level Control 18 which turns on Pump 20 at a preset level. Waste water is pumped out of Holding Tank 16 via bottom Outlet 17 by Pump 20 through Pipe 21 and into a large Settling Tank 22 which has a top lid. A second, Automatic Level Control 18*a* turns on Pump 20, at a preset level, as a safety feature. When this Level Control 18*a* is activated, an alarm and a blinking red light turn on in Control Panel 13, alerting the operator.

At this point the separation of the heavy particulates, like dirt, sand, lint, etc., takes place, and a major portion of entrained contaminants settles down to the bottom of the tank.

After a predetermined period of time, measured by a timer in Control Panel 13, the contents of the closed top Tank 22 are pumped out automatically from a preset level from the bottom by the programmable controller in Control Panel 13, through Pipe 25 by Pump 24; the pumping pressure drop is read by differential Pressure Sensor/Transmitter 26, which transmits its reading to the programmable controller in Control Panel 13. The waste water is then routed automatically through one of three filter banks, A, B or C, which is selected by the programmable controller, who opens one bank and closes the next one by operating the electrically actuated Valves 27A, 27B or 27C, based upon a preset pressure differential at the programmable controller in Panel 13. Each Electrically actuated Valves 27A, 27B and 27C has a red and a green light. The green light is on when the valve is open, the red light is on when the valve is closed.

The Programmable Controller in Panel 13, will sound an alarm if all the valves are closed.

The loaded filters are removed from their housings and backwashed clean by Filter Backwashing Machine 33. Clean filters are installed at the time the loaded filters are removed for cleaning.

Each filter bank consists of 3 large filter cartridges, piped in series so as to force the waste water to go first through a five micron Filter 28, then through a one micron Filter 29 and finally through a second one micron Filter 29. The clean, filtered water now is well below the acceptable level for disposing the contaminated waste water through Drain Pipe 30 and into the sewer system.

Sampling Outlet 31 is provided for testing the filtered water downstream of the filtering banks. The Fiber Count, in MF/L (Million Fibers/Liter) is well below the EPA allowable level for disposal through the sewers, tested by the most accurate and reliable test available—the TEM (Transmission Electron Microscopy), done by accredited, AIHA Certified Laboratory (American Industrial Hygienist Association).

The larger Settling Tank 22, as well as, the smaller Holding Tank 16 and the filter housings have no large surface of contact between the contaminated water and the ambient air, only the normal venting for filling and pumping. This feature reduces the amount of contaminants that get entrained with the water vapors and which could then be carried out through the Containment Area.

At a preset period of time, the bottoms of Settling Tank 22 are pumped out through Outlet 38, the inside is pressure washed and the sludge is disposed of accordingly to EPA regulations.

The washing machines and tank are within a Dyke 52 in order to contain any remotely possible leak. Two Vacuum Cleaners 34, equipped with HEPA filters, are kept at all times within the Containment Area, one near Washing Machines 12, the other near Pumps 20 and 24.

All the functions of the Washing Machines 12 are controlled by a built in microprocessor, including cycles, duration of cycles, amount and temperatures of water, chemical feed from Metering Pumps 15 and Chemical Storage Containers 14, as well as other features, which ensure the repeatability of the washing results.

FIG. 1. The portion of all walls facing the inside of the Containment Area are finished with smooth, white marlite in order to reduce adherence of the above listed contaminants and to facilitate the wash down of Walls: 1, 1*a*, 1*n*, 1*m*, 1*b*, 1*c*, 1*d*, 1*e*, 1*f* and 1*g*.

Prior to the start of laundering, the floor in the work area is covered with one layer of 6 mil polyethylene sheeting. At the end of each day, this sheeting is HEPA vacuumed then rolled up and disposed of, as contaminated material. The pickup and delivery system requires that the contaminated clothing be picked up by trained personnel in a facility owned licensed enclosed truck. The clothing is picked up already inside two six-mil polyethylene marked bags. These bags have already been decontaminated on the outside surface, prior to leaving the pick up area. Once picked up, the bags are placed in sealed containers inside the enclosed truck. The box truck is lined with 6 mil polyethylene sheeting on the inside.

At the laundry, the truck is backed all the way into the Containment Area 8, through Overhead Door 9. At this point, the Air Filtration Machines (HEPA) 36 start automatically. The double bags are then transferred from the truck's sealed containers to the Containment Area Sealed Containers 10. By the described handling system, assurance is attained that no contaminants would be released to the atmosphere from pickup to delivery points.

Figure 2:
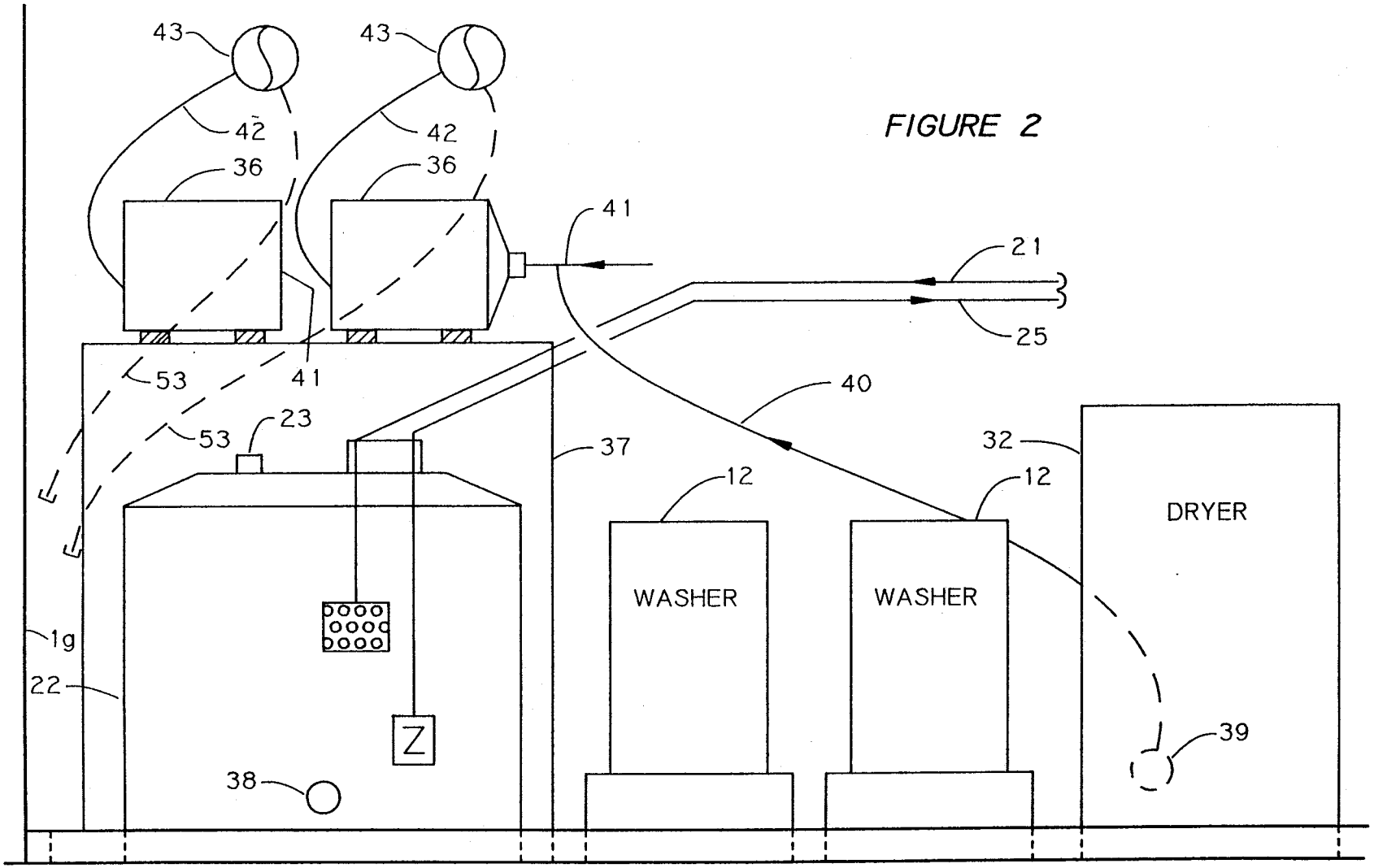
FIG. 2 is a sectional view of the settling tank, its piping, the washers, the dryer and its exhaust connection via flexible duct to one of the two HEPA Air Filtration Machines; the Air Filtration Machines set on a platform above the settling tank and their exhaust ducts connected to the outdoors.

FIG. 2. Dryer 32 has its Exhaust 39 directly connected, via Duct 40, to the Intake 41 of one of the two HEPA Air Filtration Machines 36. These HEPA Air Filtration Machines 36 are equipped with High Efficiency Particulate Absolute Filters (HEPA) rated and certified to be a minimum 99.97% efficient at 0.3 micron. In addition, these machines are equipped with two other non-HEPA prefilters, automatic controls, and loud sounding alarm and lights to warn the operator of the status of all the filters.

The outlet side of the HEPA Air Filtration Machines are connected by Duct 42 to the outdoors at Points 43 on Wall 1*c*. The two HEPA Air Filtration Machines 36 are on top of Platform 37 which stands above Settling Tank 22.

The air released to the atmosphere through Duct 42 is free of contaminants as proven by pre-established, scheduled air testings of samples taken through Sampling Outlets 53 and analyzed by AIHA Accredited Laboratories.

The suction of approximately 3600 CFM (cubic feet per minute) of air from the Containment Area 8 by HEPA Machines 36, creates a negative pressure inside said Containment Area 8, in relationship to the surrounding areas, beyond Walls 1, 1*a*, 1*h*, 1*j*, 1*k*, 1*b*, 1*c*, 1*d*, 1*e*, 1*f*, 1*g* and Overhead Door 19. The negative pressure within Containment Area 8 is maintained at minus 0.02 or less inches of water and it is documented by the use of differential pressure Documenter 47, which is an instrument used to monitor relative pressure differential. (A digital pressure manometer connected to a chart recorder for documentation and record keeping.) This instrument has both audible and visual alarms with highly visible readout; the alarm is to warn the operator of any possible failure in the negative pressure, inside the Containment Area.

HEPA Machines 36 turn on everytime Overhead Door 9 opens up and the delivery truck backs all the way into the Containment Area 8 or when the laundry process is taking place. Delivery never takes place when the laundry process is taking place.

HEPA Machines 36 change, a minimum of six times per hour, the entire volume of air in Area 8, by drawing-in fresh, clean air from the outside. This happens every time laundering is taking place.

The functioning of the HEPA Machines 36 and the negative pressure created in Containment Area 8 assure that air will always flow into the Containment Area from the clean surrounding areas and never in the opposite direction, further assuring that no contaiminants would be released to the atmosphere through the surrounding clean areas.

The vents on Vented Doors 3, 4 and 5 as well as Vent 55 on Wall 1*b* and Vent 56 on Wall 1*e* are permanent one-way, self-closing vents; that is with flaps on the negative pressure side of the air stream which flows from the surrounding clean areas into Containment Area 8 through said vents.

This vent system does not require that the operator open or close any vents.

Emergency Electrical Power Generator 57 is provided as a safety measure, in case of a failure in the electrical power supply. Should any electrical power failure occur, Emergency Generator 57, after a pre-established time delay, will automatically turn on, re-establishing all the functions within Containment Area 8, including the Air Filtration HEPA Machines.

All laundry which has been removed from Dryer 32 is placed into a sealed container and after all laundry is done and all decontamination procedures have taken place, the container is removed through the Shower Door 5, into Shower Room 45, 46, where the container is wet wiped. After showering, the operator moves the sealed, wet wiped container through Door 4 into the Clean Room 44, where he or she dresses in clean street clothes. Then he or she moves the container into Clean Area 2 through Door 3, for sorting, repairs, folding and storage.

The lint from Dryer 32 is removed everyday from the lint screen. At regular, preset periods of time, the lint from Dryer 32 is sampled and analyzed for asbestos fiber content, by AIHA Accredited Laboratory.

FIGS. 1 and 2. As claimed in this invention and as shown on FIG. 1 and 2, and as described in the description of the drawings and in the Preferred Embodiment, the Containment Area 8 does not require division by a solid wall or any other means, between washer and dryer area, because of the dramatic reduction in the amount of the listed contaminants released into the Containment Area 8, as proven by air monitoring of both the Containment Area itself, as well as, the Operator's Breathing Area, within the Containment Area in a TWA (Time Weighted Average) basis and as analyzed by an AIHA Accredited Laboratory.

The reduction in contaminants released into the Containment Area and the elimination of the need for a wall between the washers and the dryers thereof, are due to the following features of this invention:

1. Safe delivery procedures and means that ensure no contaminants are released into the Containment Area when dirty clothing bags are transferred into it.

2. Wetting of the clothing prior to pulling them out of their double bags.

3. Improved air filtration and flow control system in the Containment Area, which directs the air flow in a manner that does not allow contaminated air to flow towards the dryer, as well as the introduction of HEPA filters and other methods and means for constant monitoring of the air in the Containment Area, the Operator's Breathing Area air, the exhaust air and the negative pressure, which is introduced in the Containment Area, with respect to the surrounding areas.

4. The protection of the floors in the Containment Area by placing 6 mil polyethylene sheeting thereon.

5. The introduction of microprocessor controlled, programmable washers, which ensures repeatability of the results. Also the introduction of testings of the laundered clothing for residual contaminants, ensuring reliability in the laundering process and its results.

6. The introduction of a smooth wall finish, which substantially reduces adherence of contaminants to its surface and the washdown of all surfaces in the Containment Area after each day laundering is complete, reducing contamination possibility.

7. The utilization of enclosed waste water tank and filters, which reduces the contact of the hot, contaminated water with the Containment Area ambient air.

8. The reduction of possible human error in the closing and opening of vents by utilizing self closing flapped vents. These vents are strategically placed throughout the Containment Area in order to properly direct the flow of the clean air coming into the inside of the area: Vents 3, 4, 5, 55, 56 and Overhead Door 9 (when this door opens).

FIG. 1. Illustrates the overall layout of the facility, as herein before described.

FIG. 2. Illustrates a sectional view of the settling tank, the washers, the dryer and the HEPA Air Filtration Machines on a platform thereof. Steps 1 through 9 refer to FIGS. 1 and 2 and describe the methods.

STEP ONE

The operator has been previously thoroughly trained in the operation and the safety features of the facility. The operator turns on Red Warning Light 6, then enters Clean Room/Airlock 44, from Clean Room 2, through Vented Door 3. In Clean Room/Airlock 44, the operator changes his or her regular clothing and puts on protective coveralls, gloves, head covering, foot wear and OSHA approved respirator equipped with HEPA filters. The operator will also strap to his or her waist a personal air monitoring pump in order to monitor his or her breathing area air. The floor in Area 8 has been previously covered with a layer of 6 mil plastic.

STEP TWO

The operator proceeds through Vented Door 4, through Shower Room 45, 46, then through Vented Door 5 into Containment Area 8, where he or she proceeds to turn on both HEPA Air Filtration Machines 36, via Control Panel 13. At this point, if the filters in the Air Filtration Machines are loaded, meaning that they need replacing, or any other machine malfunction happens, a loud alarm will sound, red lights will go on at the machines and no laundering will take place until the cause for the malfunction is repaired.

STEP THREE

The operator now will turn on the high volume pump for the monitoring of the air in Area 8 and also will turn on his or her personal air monitoring pump at this time. These air samples are to be sent to an accredited laboratory for analysis, with a next day results turn around requested.

STEP FOUR

The operator picks up the double bagged dirty clothing, one bag at a time, from Sealed Containers 10 and reseals Container 10. The operator wets down the dirty clothes, by means of an airless spray gun and proceeds to load the Washing Machine 12.

At pre-established intervals the operator will take samples from the surface of a pre-established number of dirty clothing, prior to wetting them. This is done following an accepted, established procedure. The operator will also mark, with threads, the areas the samples were lifted from, then he or she will proceed to launder those clothing together with the rest. The sample will be tested by an accredited laboratory.

STEP FIVE

The operator turns on the Microprocessor Controlled, Programmable Machine 12 which proceeds, automatically, to launder the dirty clothing. The operator selects a program, which has been programmed in the machine and which is based upon the composition of the clothing itself, and only has to look up a chart and push in a numerical button indicated on the chart.

STEP SIX

The dirty waste water is automatically drained from Washing Machine 12 into Holding Tank 16 from where it is automatically pumped into Settling Tank 22 by Pump 20 and after a preset period of time it is pumped out of Settling Tank 22, by Pump 24, to the Filters 28, 29 and to the sewers through Drain Pipe 30, as previously described in detail.

On a pre-established schedule, the operator takes samples of the waste water, downstream from the filters and labels them, all accordingly with established procedures. The samples are to be immediately sent to an accredited laboratory for testing and a report.

STEP SEVEN

After laundering is complete, the operator removes the still wet clothes from Washers 12 and places them in Dryer 32 where they are dried.

STEP EIGHT

The dried clothing is then placed in a sealed, wheeled container and moved through Vented Door 5 into Shower Room 45, 46, where the operator wet wipes the wheeled container, then strips off the protective clothing and places them in a sealed container in the shower room. The operator then proceeds to take a shower and to wash clean the respirator. The respirator cartridges are disposed of at this point. The personal monitoring pump has been turned off and is also wet wiped.

On a pre-established schedule and procedure, samples are taken from the laundered clothing surface of the clothing tested in Step Four, in order to determine contaminated contents. The testings are to be made by an accredited laboratory.

STEP NINE

The operator then moves the wheeled container through Vented Door 4 into Clean Room/Air Lock 44 where he or she dresses in regular clothing and hangs up the respirator and the personal pump, then moves the wheeled container, through Vented Door 3, into Clean Room 2 for sorting, repairs, folding and storage.

Thus, it can be seen that a method and means are provided for laundering asbestos and/or lead contaminated clothing which decontaminate said clothing in a manner which ensures the safety and protects the health of the laundry operator and prevents asbestos and/or lead contamination to the atmosphere from the laundry.

Method and means are provided for laundering asbestos and/or lead contaminated clothing in an environmentally controlled, (air pressure, air flow pattern and volume, sealed in waste water) contained Laundry Area, without walls between washer and dryer areas, which does not recontaminate the clothing after laundering it and if any of the contaminants remain on the laundered clothes, the amount would be insignificant or at the most within the maximum allowed.

Method and means are also provided for:

A controlled environment enclosure defining a washer, dryer and waste water settling and filtering side without walls between them.

A clean room/air lock in communication with said washer/dryer filtering side and two solid doors with flapped vents-air inlets, one vented door communicating with the large clean room used for sorting, repairs, folding and storage of laundered clothing, the other vented door communicating with the shower room. The vents permit the air to flow only towards the shower room and beyond, but not the opposite direction.

A shower room which has a solid door with a flapped vent (air inlet) which door is communicating with the washer/dryer/filtering side. The flapped vent permits the air to flow only towards the washer, dryer area and not the opposite direction.

A one-way venting system (air inlets) with flaps, that allows the flow of air only in one direction, from the surrounding clean areas, as well as from the clean room used for sorting, repairs, folding and storage, through the clean room airlock, and through the shower room and into the washer/dryer/filtering side, which does not require the operator's attention. They are self closing air inlet flaps.

Two microprocessor controlled, programmable washers which ensure repeatability of the laundry parameters and one dryer in the washer/dryer/waste water settling and filtering side.

An asbestos and/or lead contaminated water filtering and disposal means associated with said programmable washers which operates automatically and which has failsafe features. Said filtering means, filter the waste water down to a contaminant content per liter which is acceptable for disposal through the sewer.

The installation of two state of the art Air Filtering Machines, equipped with HEPA filters for creating and maintaining a negative pressure within said washer/dryer/waste water settling and filtering area, through flapped vents on Walls 1*b* and 1*e* as well as through flapped vents on solid doors in the clean room/air lock and the shower room and through Overhead Door 9 when it opens for letting the enclosed/inside lined truck, back up all the way into the washer/dryer/filtering area.

A monitoring and alarm means to warn the operator of any failure in the level of negative pressure within the work area.

The utilization of a HEPA Air Filtering Machine for the direct filtering of the dryer exhaust air before it is exhausted to the surrounding atmosphere.

An emergency auxiliary generator, to ensure the functioning of the air filtration HEPA system as well as other elements of the process, with the purpose of protecting the health and safety of the laundry operator, as well as with the purpose of protecting the surrounding environment.

A series of alarms, warning audible and visible signals and redundant tank level control, also to ensure operator's safety and environmental protection.

Method and means to prove and ensure the health of the operator as well as the protection to the environment, by pre-established scheduled sampling of: the operator's breathing air area and the overall work area air, the air filtration HEPA machines exhaust air, the dryer exhaust air, the dryer lint, the contaminated clothing prior to and after laundering and the waste water after filtering it. The testing of all of the above samples shall be done only by independant AIHA Accredited Laboratory.

An overhead door between the outside and the washer/dryer/filtering side which opens up only when no laundering is taking place, to allow dirty clothing, in double bags, to be transferred from sealed containers in enclosed truck into sealable containers inside the washer/dryer/filtering area and only while the area is under negative pressure, which forces air flow only in one direction through overhead door and other clean areas and into the washer/dryer/filter area.

A clean room area used for sorting, counting, repairs, folding and storage of the laundered clothing said clean room communicating with the clean room/air lock through solid door with flapped vent, that allows the air to flow only from the clean room to the clean room/air lock and not the opposite direction.

Thus, it can be seen that the invention accomplishes all of the stated objectives.

What is claimed is:

1. A laundering facility, comprising:

(a) a washer area;

(b) a washer and dryer for laundering contaminated clothing in said washer area;

(c) a cleaning fluid filtering area having means for automatically monitoring and controlling cleaning fluid quality discharged from said washer area to the outside environment;

(d) a clean area for working on decontaminated clothes received from said washer area; and (e) means for automatically monitoring and controlling air quality in said washer area, in said cleaning fluid filtering area, and in said clean area, and means for monitoring and controlling air quality of the air discharged to the outside environment.

2. A laundering facility as set forth in claim 1, further comprising:

(f) microprocessor means for controlling said washer, including washer cycles, duration of cycles, fluid amount, fluid temperature, and chemical feed through metering pumps from chemical storage containers.

3. A laundering facility as set forth in claim 1, wherein said means for automatically monitoring and controlling air quality comprises means for monitoring and recording constant differential pressure between said clean area and a containment area comprising said washer area and said cleaning fluid filtering area.

4. A laundering facility as set forth in claim 3, wherein said means for automatically monitoring and controlling air quality further comprises means for constant airborne particulate monitoring, recording, and testing in said containment area, in said clean area, and in the air discharged to the outside environment.

5. A laundering facility as set forth in claim 3, wherein said means for automatically monitoring and controlling air quality further comprises means for directing air flow within said laundering facility through automatic vents away from said clean area and through high efficiency particulate absolute machines.

6. A laundering facility as set forth in claim 5, further comprising means for testing said contaminated clothing prior to washing and for testing said decontaminated clothing after washing.

7. A laundering facility as set forth in claim 1, wherein said means for automatically monitoring and controlling cleaning fluid quality discharged from said washer area to the outside environment comprises:

(i) a holding tank for receiving contaminant-containing fluid from said washer and having a first automatic level control;

(ii) a closed-top settling tank for receiving contaminant-containing fluid from said holding tank and having a second automatic level control;

(iii) means for pumping fluid from the top of said closed-top settling tank in a filter feed stream to a filter bank;

(iv) means for monitoring fluid pressure in said filter feed stream;

(v) at least three filters in parallel in said filter bank; and (vi) a programmable controller for monitoring and controlling fluid flow and pressure.

8. A laundering facility as set forth in claim 7, wherein each of said three filters comprises a first filter cartridge having a pore size of 5 microns or less, a second filter cartridge having a pore size of 1 micron or less, and a third filter cartridge having a pore size of 1 micron or less, in series.

9. A laundering facility as set forth in claim 8, wherein said programmable controller further provides audible and visual display of facility status and alarms.

10. A laundering facility as set forth in claim 8, wherein said means for automatically monitoring and controlling cleaning fluid quality discharged from said washer area to the outside environment further comprises means for testing filtered fluid downstream from said filter bank.

11. A laundering facility as set forth in claim 10, wherein said means for testing filtered fluid downstream from said filter bank comprises means for testing fiber content by transmission electron microscopy.

12. A laundering facility as set forth in claim 11, wherein said holding tank, said closed-top settling tank, and said filters have no large surface of contact between contaminated fluid and ambient air.

13. A laundering facility as set forth in claim 12, further comprising a fluid containment dyke surrounding said washer area and said cleaning fluid filtering area.

14. A laundering facility as set forth in claim 13, wherein said containment area further comprises a receiving area for receiving contaminated clothing and wherein walls facing said containment area are finished with a smooth, non-porous surface to reduce adherence of contaminants and to facilitate decontaminating washing.

15. A laundering facility as set forth in claim 14, wherein said high efficiency particulate absolute machines are programmably controlled to turn on when a delivery door to said containment area is opened and wherein said high efficiency particulate absolute machines have the size and capacity to operate to change the entire air volume in said containment area at a minimum of six times per hour.

16. A laundering facility as set forth in claim 15, wherein said automatic vents for directing air flow within said laundering facility comprise permanent one-way, self-closing vents.

17. A laundering method, comprising:

(a) providing a containment area for receiving contaminated clothing;

(b) providing a washer area in said containment area for washing, drying, and decontaminating said clothing in one room;

(c) providing a clean area for working on decontaminated clean clothes received from said washer area;

(d) automatically monitoring and controlling air quality in said containment area, in said washer area, in said clean area, and in the air discharged to the outside environment; and (e) automatically monitoring and controlling cleaning fluid quality discharged from said washer area to the outside environment.

18. A laundering method as set forth in claim 17, further comprising covering the floor area with polyethylene sheeting prior to laundering, receiving into said containment area contaminated clothing packed in polyethylene bags in sealed containers, transferring said polyethylene bags to containment-area sealed containers, placing laundry removed from said dryer in a clean clothing sealed container, and wet wiping said clean clothing sealed container prior to transferring to said clean area for further sorting, repairs, folding, counting, and storing.

19. A laundering method set forth in claim 18, further comprising using 6 mil thicknesses or greater of said polyethylene, and wetting said contaminated clothing before unpacking from said polyethylene bags into said containment area.

20. A laundering facility for cleaning and recycling contaminated clothing, comprising:

(a) a washer area;

(b) a washer and dryer in said washer area;

(c) a receiving area for accepting contaminated clothing prior to laundering in said washer area;

(d) a clean area for sorting, repair, folding, counting, and storing decontaminated clothes received from said washer area;

(e) a cleaning fluid filtering area for automatically monitoring and controlling water quality discharged from said washer area to the outside environment, comprising (i) a holding tank for receiving contaminant-containing water from said washer and having a first automatic level control;

(ii) a closed-top settling tank for receiving contaminant-containing water from said holding tank and having a second automatic level control;

(iii) means for pumping water from the top of said closed-top settling tank in a filter feed stream to a filter bank;

(iv) means for monitoring liquid pressure in said filter feed stream;

(v) at least three filters in parallel in said filter bank, each filter comprising a first filter cartridge having a pore size of 5 microns or less, a second filter cartridge having a pore size of 1 micron or less, and a third filter cartridge having a pore size of 1 micron or less, in series; and (vi) a programmable controller for monitoring and controlling liquid flow and pressure and for providing audible and visual display of facility status and alarms;

(f) means for automatically monitoring and controlling constant differential pressure and airborne particulate quality in said receiving area, in said washer area, in said cleaning fluid filtering area, in said clean area, and in the air discharged to the outside environment;

(g) microprocessor means for controlling said washer, including washer cycles, duration of cycles, water amount, water temperature, and chemical feed through metering pumps from chemical storage containers; and (h) means for directing air flow within said laundering facility through automatic vents away from said clean area and through high efficiency particulate absolute machines.

* * * * *